US006401679B1

(12) United States Patent
Self

(10) Patent No.: US 6,401,679 B1
(45) Date of Patent: Jun. 11, 2002

(54) SECTIONAL INTAKE MANIFOLD

(76) Inventor: Kevin Glen Self, Rte. 1, Box 28A, Caddo, OK (US) 74729

( * ) Notice: Subject to any disclaimer, the term of this patent is extended or adjusted under 35 U.S.C. 154(b) by 0 days.

(21) Appl. No.: 09/782,139

(22) Filed: Feb. 12, 2001

(51) Int. Cl.[7] ..... F02M 35/10
(52) U.S. Cl. ..... 123/184.31; 123/184.47; 29/888.01
(58) Field of Search ..... 123/184.31, 184.47, 123/184.21; 29/888.01

*Primary Examiner*—Noah P. Kamen

(74) *Attorney, Agent, or Firm*—James T. Robinson; Exclusivity-Law, Inc.

(57) ABSTRACT

A sectional intake manifold includes a flanged first intake manifold section having and a flanged second intake manifold section. Bolts extend through unthreaded bores in the first intake manifold section flange into threaded bores in the second intake manifold section flange to secure the first intake manifold section to the second intake manifold section. A seal is provided between the first section mating flange and the second section mating flange. A method is also provided for converting a conventional intake manifold to a sectional intake manifold according to the present invention.

22 Claims, 7 Drawing Sheets

SECTIONAL INTAKE MANIFOLD

BACKGROUND OF THE INVENTION

1. Field of the Invention

This invention relates to internal combustion engines and the like and, more particularly, but not by way of limitation, to a sectional intake manifold which permits increased access to intake runners, plenum, and vanes. The present invention also relates to a method for converting conventional intake manifolds to the sectional intake manifold according to the present invention.

The present invention also relates to a sectional exhaust manifold which permits increased access to runners, plenum, and dividers and, further, to a method for converting conventional exhaust manifolds to the sectional exhaust manifold according to the present invention.

2. Discussion

It is known in the art relating to internal combustion engines to provide an intake manifold having intake runners with openings through which a fuel-and-air mixture flows from the carburetor to the combustion chambers. It has been previously recognized that an air intake system designed for free breathing and maximum air flow increases high speed performance and combustion efficiency. A known method for increasing air flow through the air intake system, including the air intake manifold, is to modify the configuration of the intake manifold by reshaping or recontouring the interior walls of the intake runners, the plenum, and the vanes to reduce pressure drop and increase air velocity through the air inlets. Modification of the air intake runners is normally accomplished by removing metal from the interior walls of the air inlets.

Fuel injected internal combustion engines do not have carburetors. Fuel is typically injected either into the intake runners of the intake manifold or directly into the cylinder heads. Yet a similar benefit is obtained by reshaping or recontouring the interior walls of the intake runners, the plenum, and the vanes to reduce pressure drop and increase air flow through the intake manifold. Modification of the air intake runners is normally accomplished by removing metal from the interior walls of the air inlets. The amount of air available for combustion in the combustion chambers is the limitation on performance and efficiency. Thus, any improvement in air flow results in increased performance and increased efficiency.

Although the reason for the improvement produced by modification of the air intake runners is not fully understood, it is believed that the reshaping and recontouring of the interior walls of the air intake runners reduces the thickness of the boundary layer along the interior walls. With a thinner boundary layer, the flow of air through the air intake runners to the combustion chamber would be closer to the interior walls and act to follow the interior walls in laminar flow, thus enhancing flow of air through the air intake runners and into the combustion chamber.

Traditional air intake manifolds include cast aluminum intake manifolds and sheet metal manifolds. With cast aluminum intake manifolds, in particular, it is difficult to obtain access through the carburetor flange to the interior walls to perform the reshaping and recontouring which produces increased air flow to the combustion chambers. Restricted access to the plenum area limits the methods and tools which can be used. Maximum increase in air flow frequently results from reshaping and recontouring the interior walls of the air intake runners most remote from the carburetor flange.

It is further known in the art relating to internal combustion engines that a reduction in exhaust back pressure improves performance of the engine. Just as an air intake system designed for free breathing and maximum air flow increases high speed performance and combustion efficiency, an exhaust outlet system designed for maximum flow of exhaust gases also increases high speed performance and combustion efficiency. A known method for increasing flow of exhaust gases through the exhaust outlet system is to modify the configuration of the exhaust gas outlets by reshaping or recontouring the interior walls of the exhaust gas outlets to reduce exhaust back pressure and increase flow of exhaust gases through the exhaust gas outlets. Modification is normally accomplished by removing metal from the interior walls of the exhaust gas outlets.

As in the case of the intake manifolds, restricted access to exhaust manifold runners, plenum chambers, and dividers limits the extent to which metal can be removed from the interior walls of the exhaust manifold to reshape and recontour the interior walls of the exhaust manifold and reduce exhaust back pressure.

It is also well known in the art relating to internal combustion engines that the conventional intake manifold must be removed to gain access to the lifter valley to change or repair lifters. On most engines, the distributor must first be removed so the intake manifold can be removed. With a front-back sectional manifold, only the front section of the manifold must be removed to gain access to the lifter valley, leaving the back section of the intake manifold and the distributor in place. Leaving the distributor in place means the timing does not have to be reset. Further, although the distributor must also be removed, removal and replacement of the camshaft is permitted by removal of only the front section of the front-back sectional intake manifold, thereby reducing the time and labor to replace the camshaft.

The sectional intake manifold of the present invention permits increased access to permit reshaping and recontouring of intake manifold interior surfaces. A sectional exhaust manifold permits increased access to permit reshaping and recontouring of exhaust manifold interior surfaces.

SUMMARY OF THE INVENTION

The present invention provides a method and apparatus for achieving increased air flow through the intake and exhaust manifolds of an internal combustion engine. A sectional intake manifold includes a flanged first intake manifold section having and a flanged second intake manifold section. Bolts extend through unthreaded bores in the first intake manifold section flange into the threaded bores in the second intake manifold section flange. A seal is provided between said first section mating flange and said second section mating flange. A method is provided for converting a conventional intake manifold to a sectional intake manifold.

An object of the present invention is to provide a sectional intake manifold which permits greater access for reshaping and recontouring the interiors of the intake manifold runners, plenum chambers, and vanes.

Yet another object of the present invention is to provide a sectional intake manifold which permits access to the engine lifter valley by removing the front section without removal of the distributor, therefore leaving ignition timing unaffected.

Other objects, features, and advantages of the present invention will become clear from the following description of the preferred embodiment when read in conjunction with the accompanying drawings and appended claims.

DETAILED DESCRIPTION OF THE INVENTION

In the following description of the invention, like numerals and characters designate like elements throughout the figures of the drawings.

Figure 1:
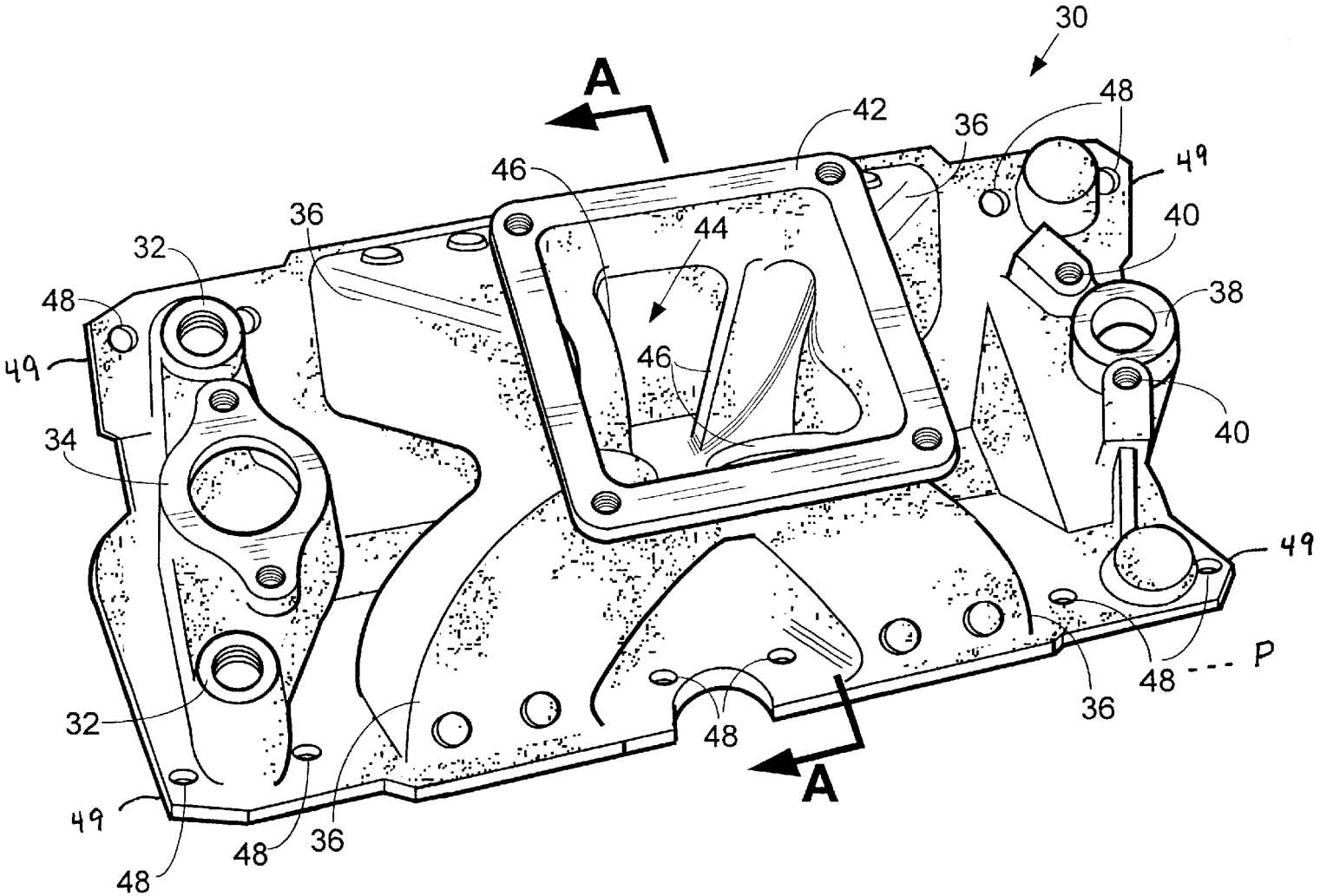
FIG. 1 (Prior Art)
FIG. 1 (prior art) is a view of a Chevrolet small-block V-8 intake manifold.

Referring generally to the drawings and more particularly to FIG. 1, a Chevrolet small-block V-8 intake manifold 30 is depicted therein. The Chevrolet small-block V-8 intake manifold 30 of FIG. 1 is a cast aluminum manifold well known in the prior art and includes cooling jacket water connections 32, a cooling water inlet 34, intake runners 36, a distributor pad 38, threaded bores 40 (used to secure a distributor (not shown)), and a carburetor flange 42 for mounting a carburetor (not shown). An interior portion 44 of the intake manifold 30 contains vanes 46 which direct the flow of a fuel/air mixture from the carburetor to combustion cylinders in cylinder heads (not shown) of an internal combustion engine. The interior portion 44 of the intake manifold 30 is sometimes also referred to as the plenum chamber or, in some cases, the plenum. As used herein, the terms interior portion 44 of the intake manifold, intake plenum, and intake plenum chamber are used interchangeably to indicate the interior portion of an intake manifold wherein the carbureted mixture of fuel and air are present prior to distribution through the intake runners 36 to the combustion cylinders in the cylinder head. The intake manifold 30 is secured to the cylinder heads (not shown) by intake manifold bolts (not shown) disposed through unthreaded bores 48 in the intake manifold cylinder head mating flange 49.

It will be understood by one skilled in the art that a Chevrolet small-block V-8 has a unique pattern of threaded bores in the cylinder heads for attachment of the intake manifolds. The threaded bores 48 in the intake manifold cylinder head mating flanges 49 must match the pattern of threaded bores in the cylinder heads. For purposes of illustration, the pattern oil the unthreaded bores in the intake manifold cylinder head mating flange 49 is designated as P.

The intake runners 36, as depicted in FIG. 1, are typical of intake runners in a cast V-8 intake manifold such as the Chevrolet small-block V-8 intake manifold, V-6 intake manifolds, 4-cylinder intake manifold, in-line 6-cylinder intake manifolds, Ford V-8 intake manifolds, and Chrysler intake manifolds. The intake manifolds selected herein for illustration of the present: invention are not inclusive; the sectional intake manifold of the present invention applies to both carbureted and fuel injected internal combustion engines. A person skilled in the art will understand that numerous variations of a cast intake manifold exist in the art, and that each variation includes intake runners, plenum chamber, and interior vanes which can be reshaped and recontoured to improve air flow to the combustion cylinders and thereby improve engine performance.

Further, a person skilled in the art will understand that intake manifolds having individual runners (commonly referred to in the field as IR manifolds), while lacking a plenum chamber, are nonetheless susceptible to reshaping and recontouring to improve air flow through the individual runners to the combustion cylinders for improved engine performance.

Figure 2:
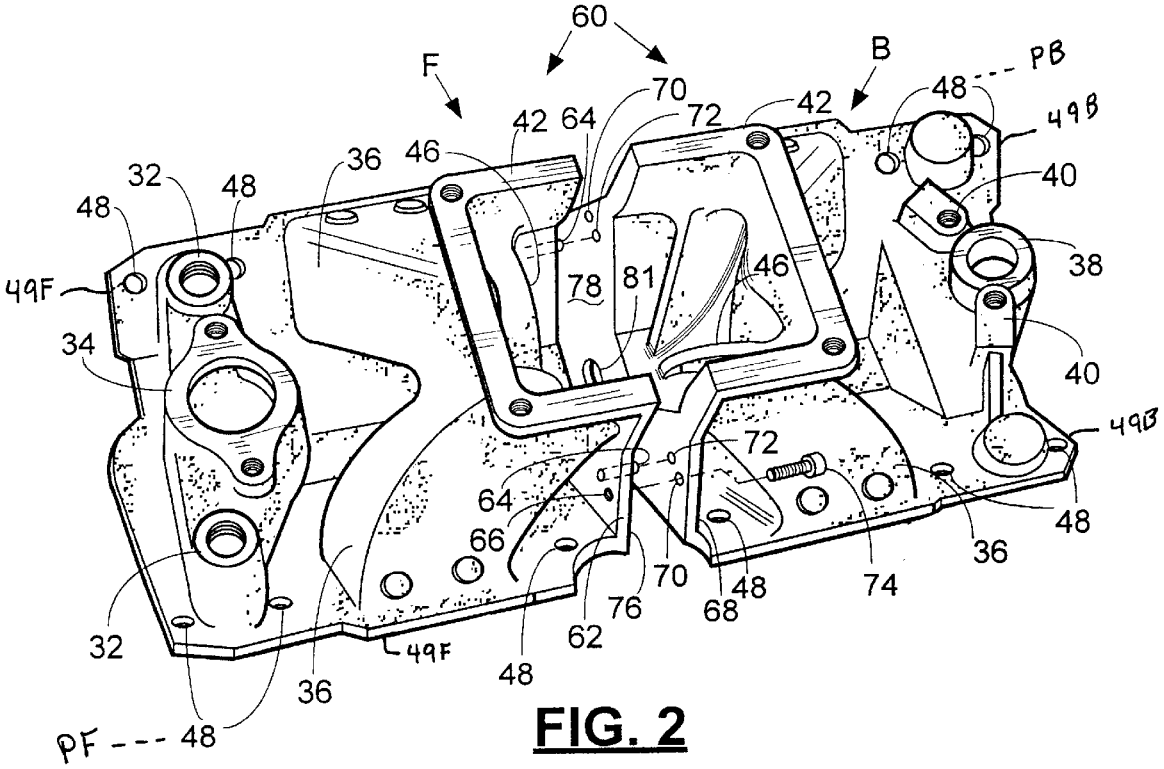
FIG. 2 is a view of the intake manifold of FIG. 1 modified according to the present invention to create a front section F and a back portion B.
Figure 3:
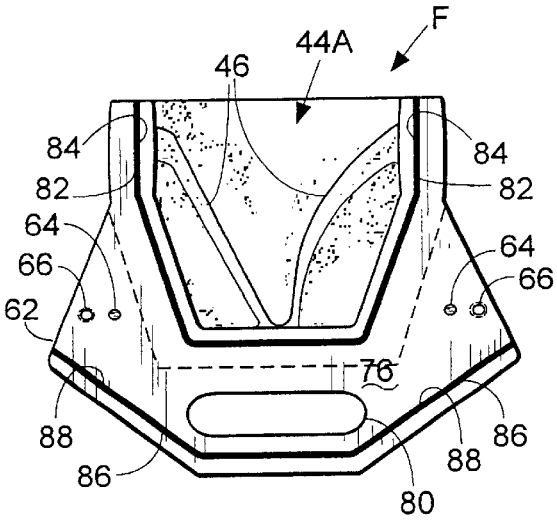
FIG. 3 is a view of the front section F of the modified intake manifold of FIG. 2.
Figure 4:
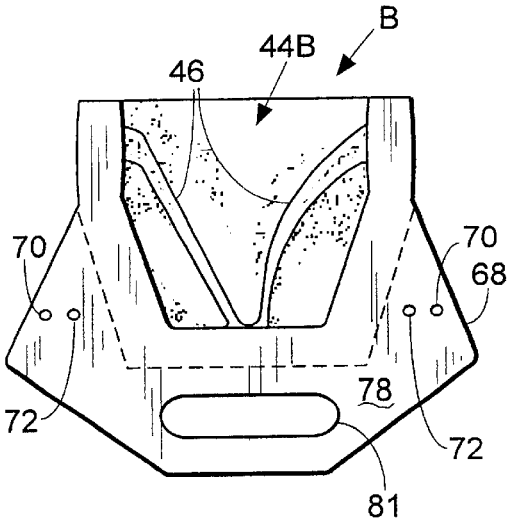
FIG. 4 is a view of the back section B of the modified intake manifold of FIG. 2.

Referring now to FIGS. 2–4, shown therein is the prior art intake manifold of FIG. 1 modified according to the present invention to create a sectional intake manifold 60. In FIG. 2, the intake manifold 30 has been cut generally along A—A and further modified as discussed hereinafter to create a front section F containing the cooling water jacket connections 32 and a back section B containing the distributor pad 38. A front section mating flange 62 has two positioning pins 64 and two threaded bores 66. The back section B includes a back section mating flange 68 having two unthreaded bores 70. The unthreaded bores 70 are aligned with the threaded bores 66 in the front section F, and two positioning pin guides 72 are aligned with the positioning pins 64 in the front section F. Two bolts 74 are disposed through the unthreaded bores 70 in the back section B into the threaded bores 66 in the front section F.

Referring now to FIGS. 1 and 2, the intake manifold cylinder head mating flanges 49 in FIG. 1 are 49F and 49B on the front section F and the back section B, respectively. PF is the hole pattern for the unthreaded bores 48 in the front section F, and PB is the hole pattern for the unthreaded bores 48 in the back section B. When the sectional intake manifold 60 is assembled as described hereinabove, the hole pattern PF and the hole pattern PB, together, create the hole pattern P of the prior art intake manifold 30.

It is known in the art to lay up aluminum, by means of a welding process, as required to create aluminum metal in a desired location. The laid-up aluminum can then be machined or ground as desired to achieve a particular surface configuration. According to the present invention, the front section F and the back section B of the sectional intake manifold 60 are created by first cutting the prior art intake manifold 30 generally along A—A to produce a front half and a back half, then welding sheets of aluminum to the front and back halves, respectively, of the intake manifold 30. The front mating flange face 76 and back mating flange face 78 are produced by precision machining of the sheets of aluminum so that, when the front section F is secured to the back section B by the bolts 74, the unthreaded bores 48 in the sectional intake manifold 60 are properly configured for attachment of the sectional intake manifold 60 to engine cylinder heads (not shown).

The mating flanges 62, 68 include airways 80 and 81, respectively (See FIGS. 3–4), to provide airflow beneath the plenum chamber 44 of the sectional intake manifold 60. The air flow is required to cool the sectional intake manifold 60 generally and the plenum chamber, now consisting of a front plenum chamber section 44F and a back plenum chamber section 44B, in particular.

Referring now to FIG. 4, shown therein is the a cross-sectional view of the front section F of the sectional intake manifold 60. Compression gaskets 82, 86 are disposed within grooves 84, 88, respectively, to provide a seal between the mating flanges 62 and 68. It will be understood by one skilled in the art that the sectional intake manifold 60, when assembled, has the same overall dimensions as the prior art intake manifold 30. The front section mating flange 62 and the back section mating flange 68 are machined so that, when the bolts 74 are tight, the compression gaskets 82, 86 are compressed and the unthreaded bores 48 are aligned with threaded bores on the cylinder heads (not shown).

The improved access to the intake manifold plenum chamber 44, runners 36, and vanes 46 is illustrated in FIGS. 3 and 4. Front section F and back section B, according to the present invention, are open for easy access through both the carburetor flange 42 and through the mating flanges 62, 68. Further, because of the improved access to the plenum chamber 44, the runners 36, and the vanes 46, each section, F and B, of the sectional intake manifold can be mounted in a fixture for reshaping and recontouring using modern Computer Numerically Controlled (commonly referred to as CNC) milling machines. Thus, time-consuming manual reshaping and recontouring operations can be automated and standardized in a precision machining process.

Although the sectional intake manifold of the present invention has been illustrated with a carburetor-type intake manifold, it will be understood by one skilled in the art that the improved performance and efficiency resulting from increased air flow is independent of the method of fuel introduction. That is, improved air flow to the combustion chambers improves the performance and efficiency of both carbureted and fuel injected internal combustion engines.

Figure 5:
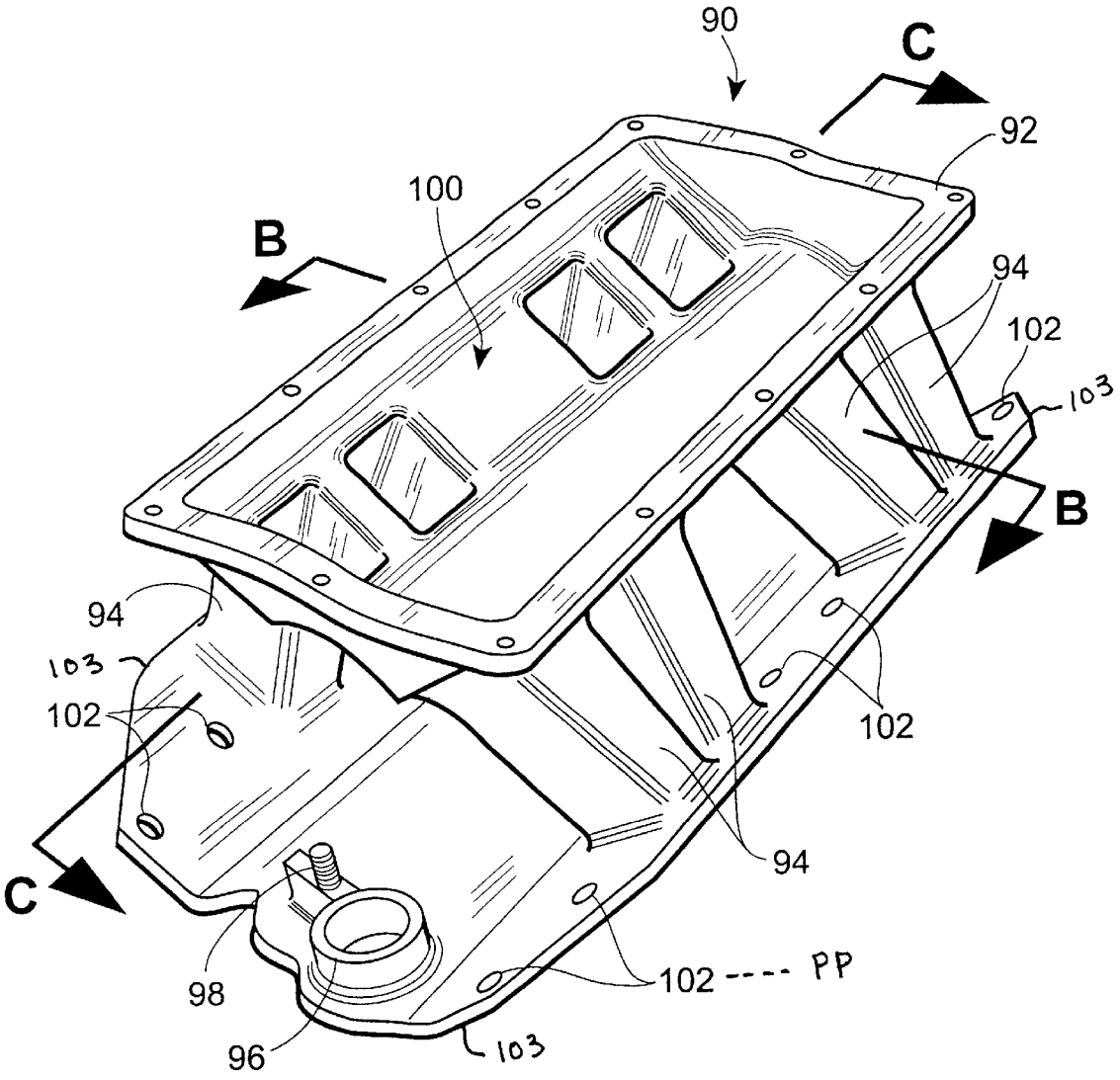
FIG. 5 (Prior Art)
FIG. 5 (prior art) is a vew of a small-block V-8 sheet metal intake manifold with bonnet removed.

Referring now to FIG. 5, shown therein is is a view of a small-block V-8 sheet metal intake manifold 90 with bonnet (not shown) removed from a bonnet flange 92. The small-block V-8 sheet metal manifold 90 of FIG. 5 is well known in the prior art and includes intake runners 94, a distributor pad 96, and a threaded post 98 (used to secure a distributor (not shown)). The intake runners 90 direct the flow of a fuel/air mixture from the interior portion 100 to combustion cylinders in cylinder heads (not shown) of an internal combustion engine. The interior portion 100 of the intake manifold 90 is sometimes also referred to as the plenum chamber, the plenum area, or the plenum. The intake manifold 90 is secured to the cylinder heads (not shown) by intake manifold bolts (not shown) disposed through unthreaded bores 102 in the intake manifold cylinder head mating flange 103.

It will be understood by one skilled in the art that a small-block V-8 has a unique pattern of threaded bores in the cylinder heads for attachment of the intake manifolds. The threaded bores 102 in the intake manifold cylinder head mating flanges 103 must match the pattern of threaded bores in the cylinder heads. For purposes of illustration, the pattern of the unthreaded bores 102 in the intake manifold cylinder head mating flange 103 is designated as PP.

Figure 6:
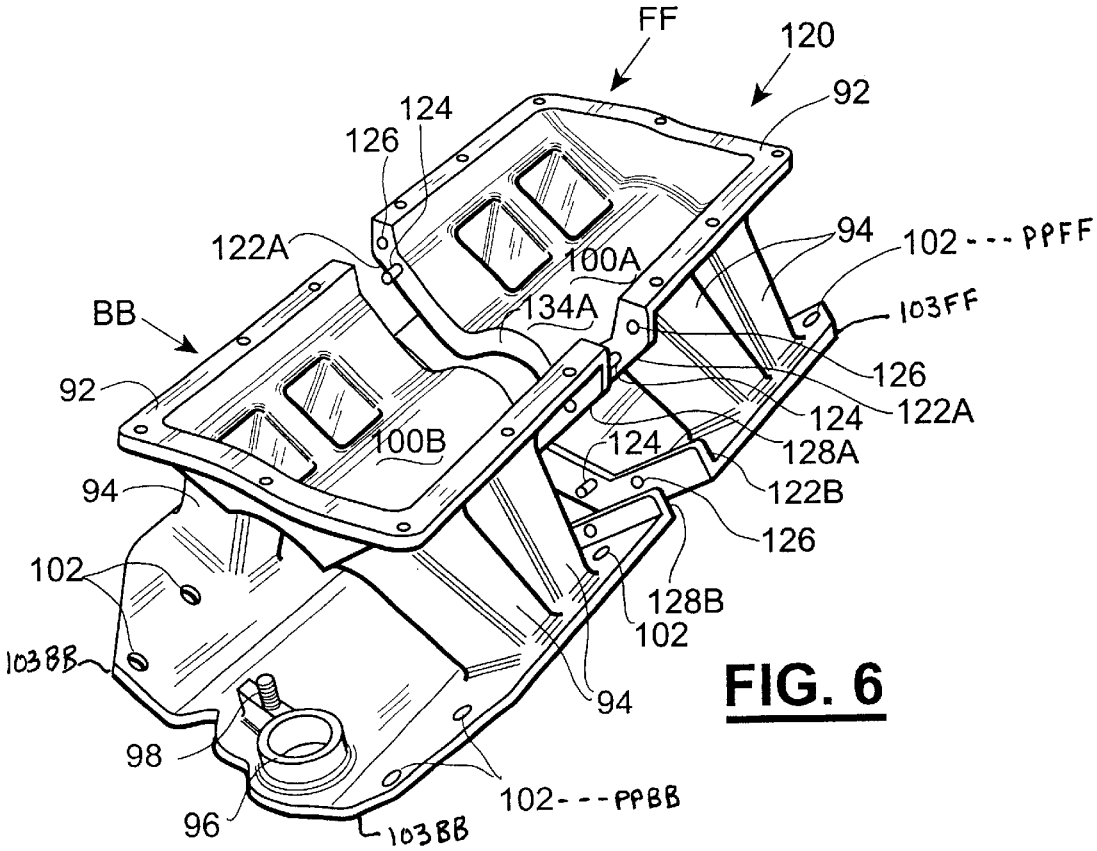
FIG. 6 is a view of the intake manifold shown in FIG. 5 modified according to the present invention to create a front section FF and a back section BB.

Referring now to FIGS. 5 and 6, the intake manifold cylinder head mating flanges 103 in FIG. 1 are 103F and 103B in the front section FF and the back section BB, respectively (See FIG. 6). In FIG. 6, PPFF is the hole pattern for the unthreaded bores 102 in the front section FF, and PPBB is the hole pattern for the unthreaded bores 102 in the back section BB. When the sectional intake manifold 120 is assembled as described herein, the hole pattern PPFF and the hole pattern PPBB, together, recreate the hole pattern PP of the prior art intake manifold 90.

The intake runners 94, as depicted in FIG. 5, are typical of intake runners in a sheet metal manifold such as the small-block V-8 sheet metal intake manifold. A person skilled in the art will understand that numerous variations of a sheet metal intake manifold exist in the art, and that each variation includes intake runners, plenum chamber, and vanes which can be reshaped and recontoured to improve air flow to the combustion cylinders and thereby improve engine performance.

Figure 7:
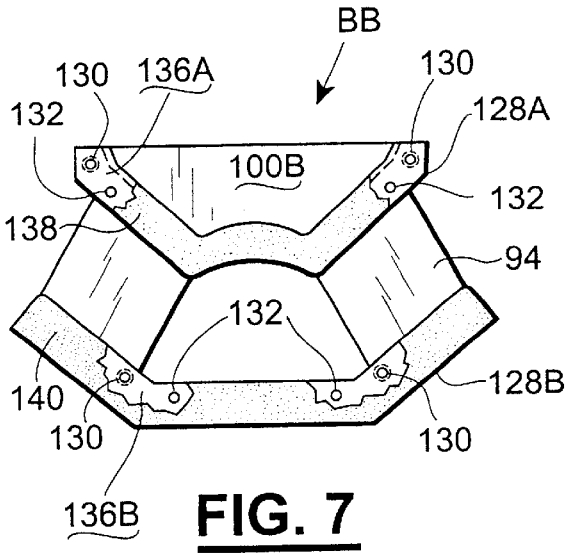
FIG. 7 is a cross-sectional view of the front section FF of the modified intake manifold shown in FIG. 6.
Figure 8:
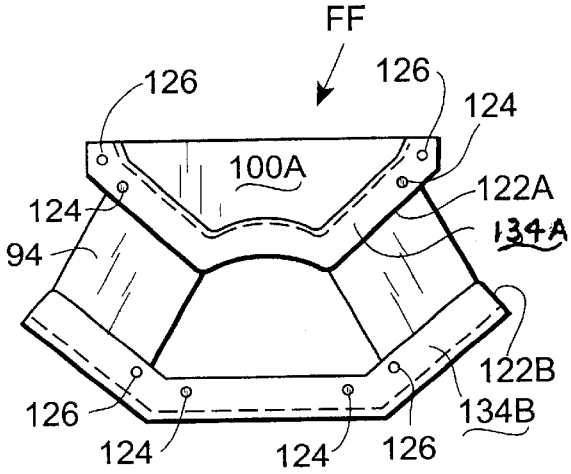
FIG. 8 is a cross-sectional view of the back portion BB of the modified intake manifold shown in FIG. 6.

Referring now to FIGS. 6–8, shown therein is the prior art intake manifold of FIG. 5 modified according to the present invention to create a sectional intake manifold 120. In FIG.6, the sectional intake manifold 120, formed from pieces produced by cutting generally along B—B as shown in FIG. 5, and further modified as discussed hereinafter to create a front section FF and a back section BB containing the distributor pad 38. The front section FF includes an upper front section mating flange 122A and a lower front section mating flange 122B. The upper front section mating flange 122A has two positioning pins 124 and two unthreaded bores 126. The lower front section mating flange 122B likewise has two positioning pins 124 and two unthreaded bores 126. The back section BB includes an upper back section mating flange 128A and a lower back section mating flange 128B. The upper back section mating flange 128A has two threaded bores 130, aligned with the unthreaded bores 126 in the upper front section mating flange 122A, and two positioning pin guides 132 aligned with the positioning pins 124 in the upper front section mating flange 122A. The lower back section mating flange 128B has two threaded bores 130, aligned with the unthreaded bores 126 in the lower front section mating flange 122B, and two positioning pin guides 132 aligned with the positioning pins 124 in the lower front section mating flange 122B. Two bolts (See FIG. 2) are disposed through the unthreaded bores 126 in the upper front section mating flange 122A into the threaded bores 130 in the upper back section mating flange 128A. Two additional bolts 74 are disposed through the unthreaded bores 126 in the lower front section mating flange 122B into the threaded bores 130 in the lower back section mating flange 128B.

According to the present invention, the front section FF and the back section BB of the sectional intake manifold 120 are created by first cutting the prior art intake manifold 90 generally along B—B to produce a front half and a back half, then welding sheets of aluminum to the front and back halves, respectively, (one sheet at the top and one sheet at the bottom of each half) of the intake manifold 90. Upper front mating flange face 134A, lower front mating flange face 134B, upper back mating flange face 136A, and lower back mating flange face 136B are produced by precision machining the sheets of aluminum so that, when the front section F is secured to the back section B by the bolts 74, the unthreaded bores 102 in the sectional intake manifold 120 are properly configured for attachment of the sectional intake manifold 120 to the cylinder heads (not shown).

Individual intake runners 94 extend from the plenum chamber 100 (100A and 100B in the sectional intake manifold 120). Further, the use of upper mating flanges (122A, 128A) and lower mating flanges (122B, 128B) leaves an airway to permit cooling of the sectional intake manifold 120 generally and of the plenum 100A, 100B particularly.

Referring now to FIG. 7, shown therein is the a cross-sectional view of the back section BB of the sectional intake manifold 120. A gasket 138 provides a seal between the upper mating flanges 122A and 128A. A second gasket 140 provides a seal between the lower mating flanges 122B and 128B. The gaskets 138, 140 are partially cut away to show the threaded bores 130, and the positioning pin guides 132 on the upper back section mating flange 128A and the lower back section mating flange 128B. The back section plenum chamber 100B is that part of the plenum chamber 100 associated with the back section BB following modification according to the present invention.

FIG. 8 is a cross-sectional view of the front section FF of the sectional intake manifold 120. The front section plenum chamber 100A is that part of the plenum chamber 100 associated with the front section FF. Positioning pins 124 and unthreaded bores 126 are shown both in the upper front section mating flange 122A and also in the lower front section mating flange 122B.

The improved access to the intake manifold plenum chamber 100 and intake runners 94 is illustrated in FIGS. 6–8. Front section FF and back section BB, according to the present invention, are open for easy access through both the bonnet flange 92 and through the mating flanges 122A, 128A. Further, because of the improved access to the plenum chamber 100A, 100B and the runners 94, each section FF and BB of the sectional intake manifold can be mounted in a fixture for reshaping and recontouring using modern computer numerically controlled (CNC) milling machines. Thus, time-consuming manual reshaping and recontouring operations can be automated and standardized in a precision machining process.

Figure 9:
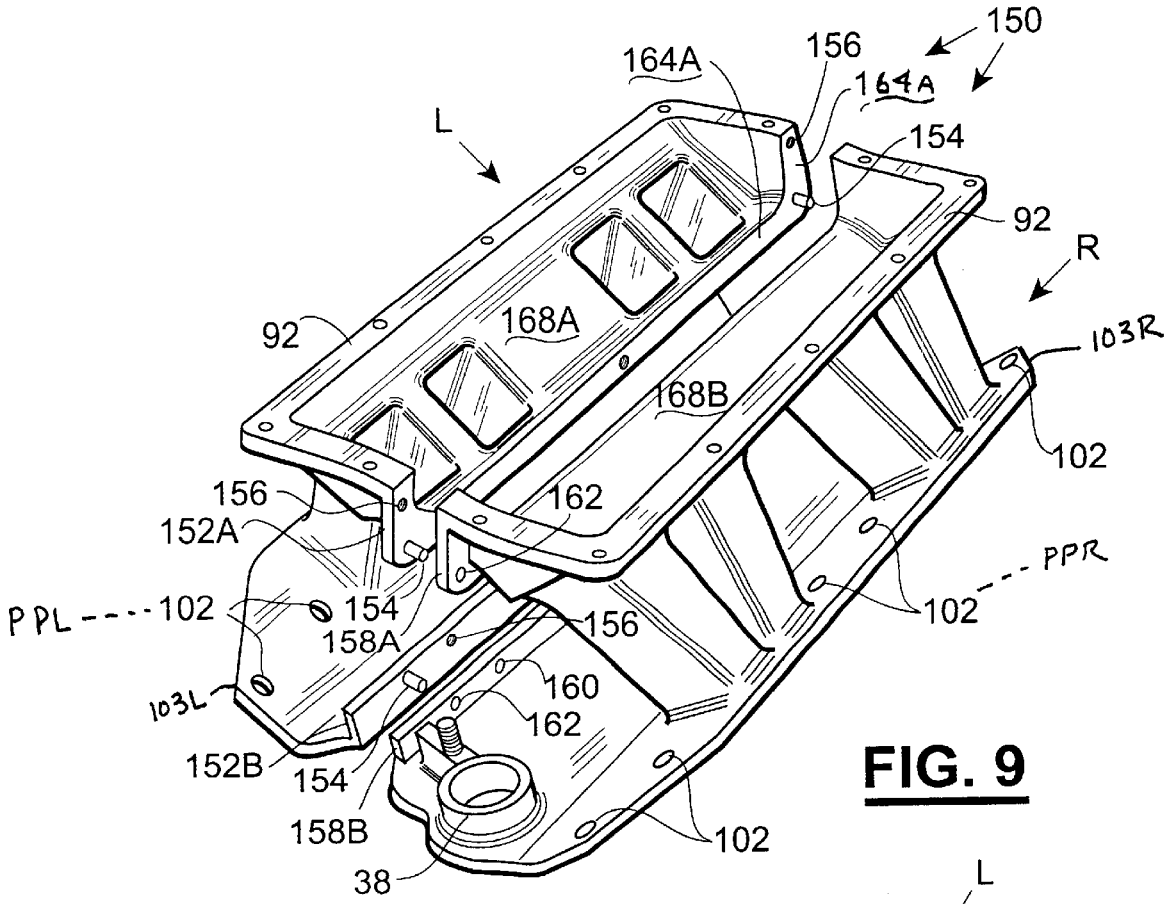
FIG. 9 is a view of the intake manifold shown in FIG. 5 modified according to the present invention to create a left section L and a right section R.
Figure 10:
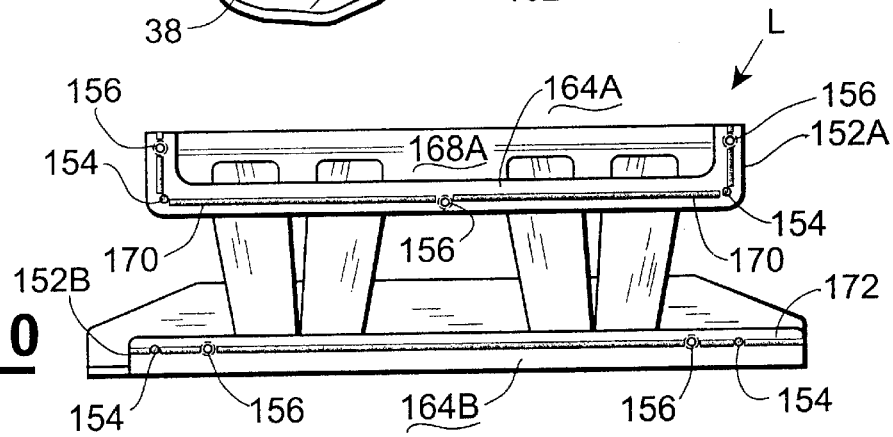
FIG. 10 is a cross-sectional view of the left section L of the modified intake manifold shown in FIG. 9.
Figure 11:
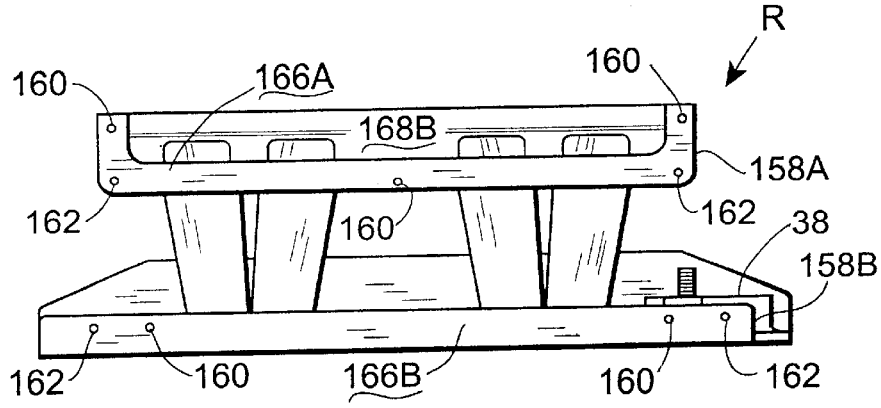
FIG. 11 is a cross-sectional view of the right section R of the modified intake manifold shown in FIG. 9.

Referring now to FIGS. 9–11, shown therein is the prior art intake manifold of FIG. 5 modified according to the present invention to create a sectional intake manifold 150. In FIG. 9, the sectional intake manifold 150 includes a left section L and a right section R containing the distributor pad 38. The left section L includes an upper left section mating flange 152A and a lower left section mating flange 152B. The upper left section mating flange 152A has two positioning pins 154 and three threaded bores 156 (See FIG. 10). The lower left section mating flange 152B has two positioning pins 154 and two threaded bores 156. The right section R includes an upper right section mating flange 158A and a lower right section mating flange 158B. The upper right section mating flange 158A has three unthreaded bores 160, aligned with the threaded bores 156 in the upper left section mating flange 152A, and two positioning pin guides 162 aligned with the positioning pins 154 in the upper left section mating flange 152A. The lower right section mating flange 158B has two unthreaded bores 160, aligned with the threaded bores 156 in the lower left section mating flange 152B, and two positioning pin guides 162 aligned with the positioning pins 154 in the lower left section mating flange 152B. Three bolts (See FIG. 2) are disposed through the unthreaded bores 160 in the upper right section mating flange 158A into the threaded bores 156 in the upper left section mating flange 152A. Two additional bolts 74 are disposed through the unthreaded bores 160 in the lower right section mating flange 158B into the threaded bores 156 in the lower left section mating flange 152B.

Referring now to FIGS. 5 and 9, the intake manifold cylinder head mating flanges 103 in FIG. 5 are 103L and 103R in the left section L and the right section R, respectively (See FIG. 6). PL is the hole pattern for the unthreaded bores 102 in the left section L, and PR is the hole pattern for the unthreaded bores 102 in the right section R. When the sectional intake manifold 150 is assembled as described herein, the hole pattern PL and the hole pattern PR, together, create the hole pattern PP of the prior art intake manifold 90.

According to the present invention, the left section L and the right section R of the sectional intake manifold 150 are created by first cutting the prior art intake manifold 90 generally along C—C to produce a front half and a back half, then welding sheets of aluminum to the left and right halves, respectively, (one sheet at the top and one sheet at the bottom of each half) of the intake manifold 90. Upper left section mating flange face 164A, lower left section mating flange face 164B, upper right section mating flange face 166A, and lower right section mating flange face 166B are produced by precision machining the sheets of aluminum so that, when the right section R is secured to the left section L by the bolts 74, the unthreaded bores 102 in the sectional intake manifold 150 are properly configured for attachment of the sectional intake manifold 150 to the cylinder heads (not shown). The use of upper mating flanges (152A, 158A) and lower mating flanges (152B, 158B) leaves an airway to permit cooling of the sectional intake manifold 150 generally and of the plenum areas 168A, 168B in particular.

Referring now to FIG. 10, shown therein is a cross-sectional view of the left section L of the sectional intake manifold 150. A bead of sealant 170 provides a seal between the upper mating flanges 152A and 158A. A second bead of sealant 172 provides a seal between the lower mating flanges 152B and 158B. Sealants are well known in the art and include, without limitation, silicone-type sealants and numerous other sealants used to seal mating surfaces in automobile engines.

Still referring to FIG. 10, a plenum area 168A is that part of the plenum 100 (See FIG. 5) now associated With the left section L. The threaded bores 156 and the positioning pins 154 are shown both in the upper left section mating flange 152A and also in the lower left section mating flange 152B.

FIG. 11 is a cross-sectional view of the right section R of the sectional intake manifold 150. A plenum area 168B is that part of the plenum now associated with the right section R. The unthreaded bores 160 in the upper right section mating flange 158A, and also in the lower right section mating flange 158B, are aligned with the threaded bores 156 in the upper left section mating flange 152A and also in the lower left section mating flange 152B, respectively. The positioning pin guides 162 in the upper right section mating flange 158A, and also in the lover right section mating flange 158B, are aligned with the positing pins 154 in the upper left section mating flange 152A, and also in the lower left section mating flange 152B, respectively.

The improved access to the intake manifold plenum chamber 168A, 168B and intake runners 94 is illustrated in FIGS. 9–11. Left section L and right section R, according to the present invention, are open for easy access through both the bonnet flange 92 and through the mating flanges 152A, 158A. Further, because of the improved access to the plenum chamber 168A, 168B and the runners 94, each section L and R of the sectional intake manifold 150 can be mounted in a fixture for reshaping and recontouring using modern computer numerically controlled (CNC) milling machines. Thus, time-consuming manual reshaping and recontouring operations can be automated and standardized in a precision machining process.

Figure 12:
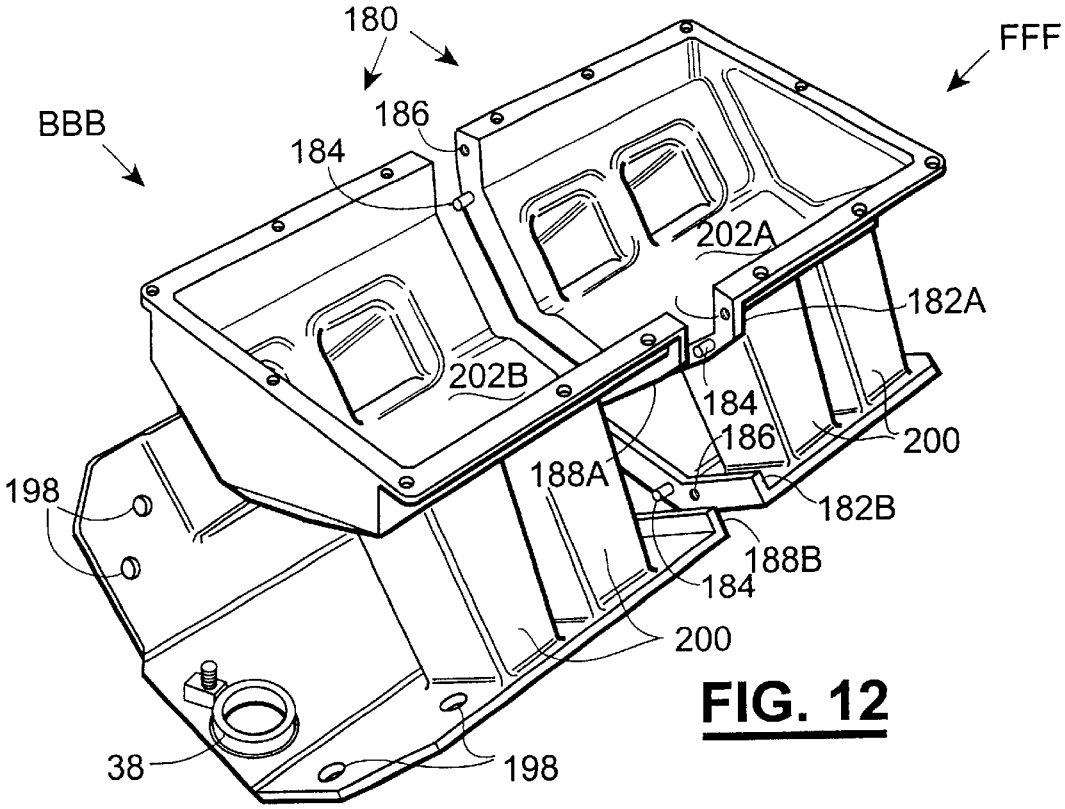
FIG. 12 is a view of a big-block V-8 sheet metal intake manifold modified according to the present invention to create a front section FFF and a back section BBB.
Figure 13:
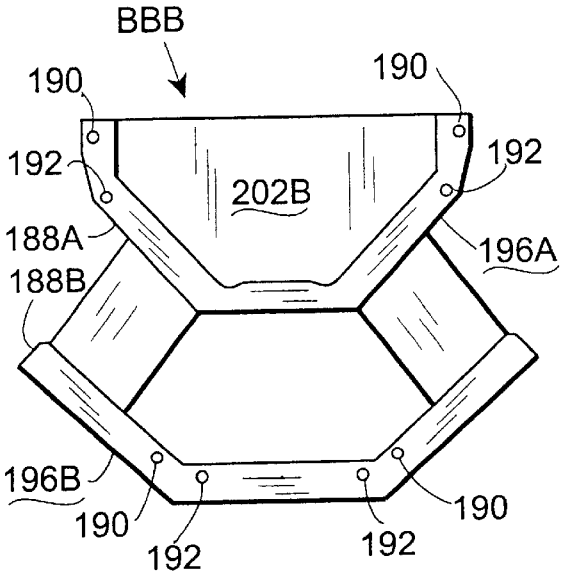
FIG. 13 is a cross-sectional view of the front section FFF of the modified intake manifold shown in FIG. 12.
Figure 14:
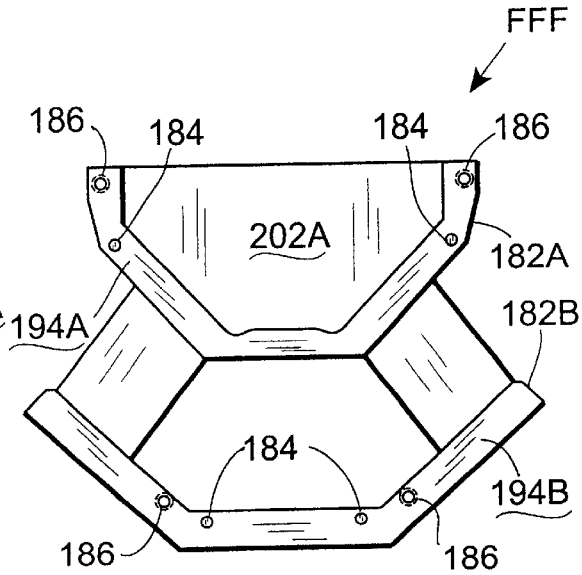
FIG. 14 is a cross-sectional view of the back portion BBB of the modified intake manifold shown in FIG. 12.

Referring now to FIGS. 12–14, shown therein is a big block sheet metal V-8 sectional intake manifold 180 according to the present invention. In FIG. 12, the sectional intake manifold 180 includes a front section FFF and a back section BBB containing the distributor pad 38. The front section FFF includes an upper front section mating flange 182A and a lower front section mating flange 182B. The upper front section mating flange 182A has two positioning pins 184 and two threaded bores 186. The lower front section mating flange 182B likewise has two positioning pins 184 and two threaded bores 186. The back section BBB includes an upper back section mating flange 188A and a lower back section mating flange 188B. The upper back section mating flange 188A has two unthreaded bores 190, aligned with the threaded bores 186 in the upper front section mating flange 182A, and two positioning pin guides 192 aligned with the positioning pins 184 in the upper front section mating flange 182A. The lower back section mating flange 188B has two unthreaded bores 190, aligned with the threaded bores 186 in the lower front section mating flange 182B, and two positioning pin guides 192 aligned with the positioning pins 124 in the lower front section mating flange 182B. Two bolts (See FIG. 2) are disposed through the unthreaded bores 190 in the upper back section mating flange 188A Into the threaded bores 186 in the upper front section mating flange 182A. Two additional bolts 74 are disposed through the unthreaded bores 190 in the lower back section mating flange 188B into the threaded bores 186 in the lower front section mating flange 182B.

According to the present invention, the front section FFF and the back section BBB of the sectional intake manifold 180 are created by first cutting a prior art big block sheet metal V-8 intake manifold (not shown) to produce a front half and a back half, then welding sheets of aluminum to the front and back halves, respectively, (one sheet at the top and one sheet at the bottom of each half) of the big block sheet metal V-8 intake manifold. Upper front mating flange face 194A, lower front mating flange face 194B, upper back mating flange face 196A, and lower back mating flange face 196B are produced by precision machining the sheets of aluminum so that, when the back section BB is secured to the front section FF by bolts 74 (See FIG. 2), unthreaded bores 198 in the sectional intake manifold 180 are properly configured for attachment of the sectional intake manifold 180 to the cylinder heads (not shown).

For ease of illustration, the sheet metal intake manifolds depicted herein are shown with the bonnet removed. It will be understood by one skilled in the art that the sectional intake manifold according to the present invention may include, if desired, a sectional bonnet flanged in accordance with the teaching herein.

Individual intake runners 200 extend from the plenum areas 200A and 200B in the sectional intake manifold 180. Between the upper mating flanges (182A, 188A) and the lower mating flanges (182B, 188B) an airway permits cooling of the sectional intake manifold 180 generally and of the plenum areas 202A, 202B, in particular.

Referring now to FIG. 13, shown therein is a cross-sectional view of the back section BBB of the sectional intake manifold 180. Although not shown, gaskets, O-rings, or other seal-creating devices are disposed between the upper mating flanges 182A and 188A and also between the lower mating flanges 182B and 188B. See FIG. 3, reference numerals 83 and 86 (O-ring type compression gaskets), FIG. 7, reference numerals 138 and 140 (flat gaskets), and FIG. 10 (bead of silicone sealant). It will be understood by one skilled in the art that any suitable seal will seal the adjacent mating flanges of the sectional intake manifold.

FIG. 14 is a cross-sectional view of the front section FFF of the sectional intake manifold 180.

Figure 15:
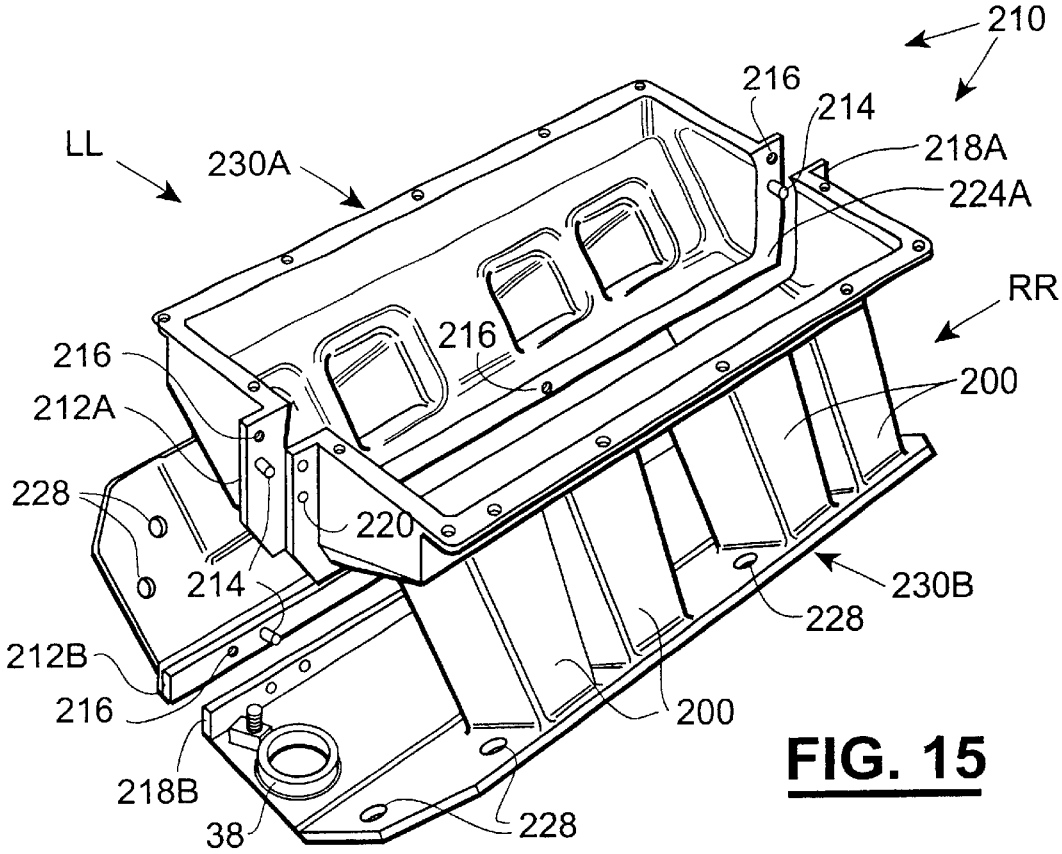
FIG. 15 is a view of a big-block V-8 sheet metal intake manifold modified according to the present invention to create a left section LL and a right section RR.
Figure 16:
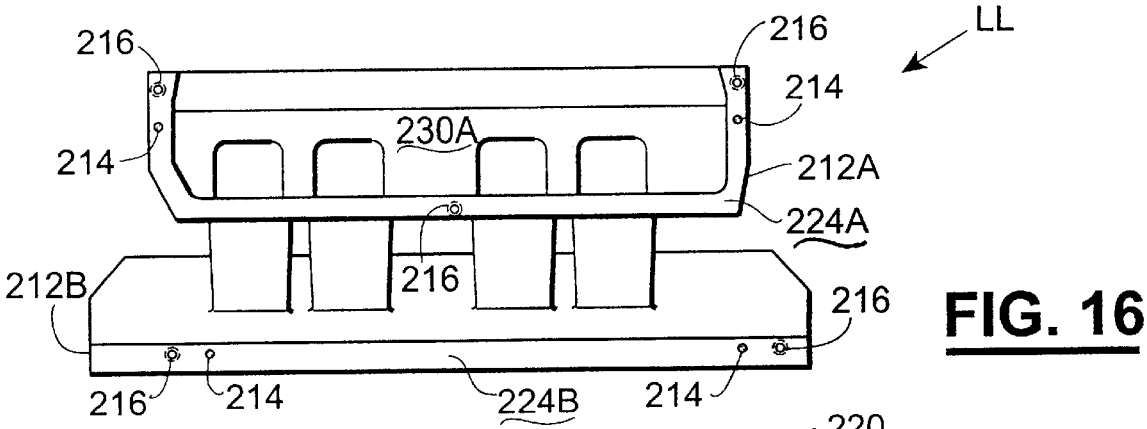
FIG. 16 is a cross-sectional view of the left section LL of the modified sheet metal intake manifold shown in FIG. 15.
Figure 17:
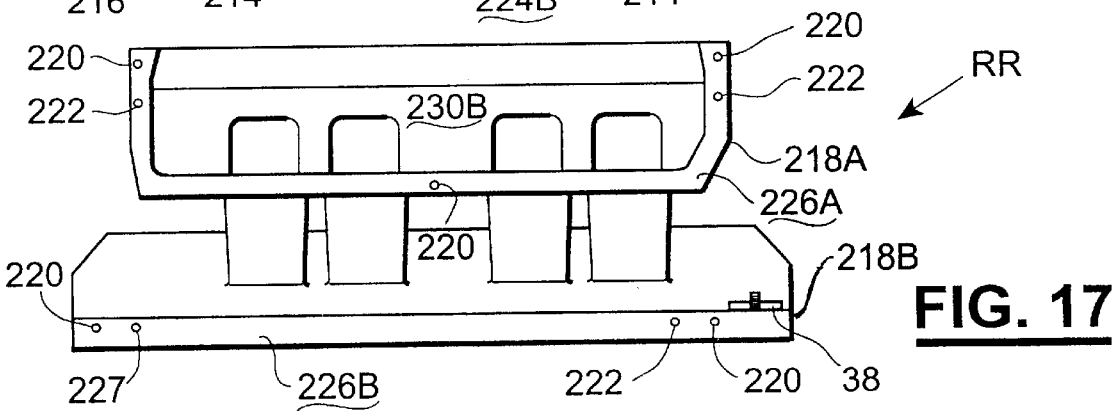
FIG. 17 is a cross-sectional view of the right section RR of the modified sheet metal intake manifold shown in FIG. 15.

Referring now to FIGS. 15–17, shown therein is also a big block sheet metal V-8 sectional intake manifold 210 according to the present invention. In FIG.15, the sectional intake manifold 210 includes a left section LL and a right section RR containing the distributor pad 38. The left section LL includes an upper left section mating flange 212A and a lower left section mating flange 212B. The upper left section mating flange 212A has two positioning pins 214 and three threaded bores 216 (See FIG. 16). The lower left section mating flange 212B has two positioning pins 214 and two threaded bores 216. The right section RR includes an upper right section mating flange 218A and a lower right section mating flange 218B. The upper right section mating flange 218A has three unthreaded bores 220, aligned with the threaded bores 216 in the upper left section mating flange 212A, and two positioning pin guides 222 aligned with the positioning pins 214 in the upper left section mating flange 212A. The lower right section mating flange 218B has two unthreaded bores 220, aligned with the threaded bores 216 in the lower left section mating flange 212B, and two positioning pin guides 222 aligned with the positioning pins 214 in the lower left section mating flange 212B. Three bolts (See FIG. 2) are disposed through the unthreaded bores 220 in the upper right section mating flange 218A into the threaded bores 216 in the upper left section mating flange 212A. Two additional bolts are disposed through the unthreaded bores 220 in the lower right section mating flange 218B into the threaded bores 216 in the lower left section mating flange 212B.

According to the present invention, the left section LL and the right section RR of the sectional intake manifold 210 are created by first cutting a prior art big block sheet metal V-8 intake manifold to produce a front half and a back half, then welding sheets of aluminum to the left and right halves, respectively, (one sheet at the top and one sheet at the bottom of each half) of the sectioned intake manifold. Upper left section mating flange face 224A, lower left section mating flange face 224B, upper right section mating flange face 226A, and lower right section mating flange face 226B are produced by precision machining the sheets of aluminum so that, when the right section RR is secured to the left section LL, the unthreaded bores 228 in the sectional intake manifold 210 are properly configured for attachment of the sectional intake manifold 210 to the cylinder heads (not shown). The use of upper mating flanges (212A, 218A) and lower mating flanges (212B, 218B) leaves an airway to permit cooling of the sectional intake manifold 210 generally and of the plenum 230A, 230B, in particular.

The improved access to the intake manifold plenum chamber 230A, 230B and intake runners 200 is illustrated in FIGS. 15–17. Left section LL and right section RR, according to the present invention, are open for easy access through both the bonnet flange and through the mating flanges 212A, 218A. Further, because of the improved access to the plenum area 230A, 230B and the runners 200, each section LL and RR of the sectional intake manifold 210 can be mounted in a fixture for reshaping and recontouring using modern computer numerically controlled (CNC) milling machines. Thus, time-consuming manual reshaping and recontouring operations can be automated and standardized in a precision machining process.

Referring now to FIG. 16, a cross-sectional view of the left section LL of the sectional intake manifold 210 shows the positioning pins 214 and the threaded bores 216 in the upper left section mating flange 212A and also in the lower left section mating flange 212B.

Referring now to FIG. 17, a cross-sectional view of the right section RR of the sectional intake manifold 210 shows positioning pin guides 222 in the upper right section mating flange 218A and also in the lower right section mating flange 218B. The positioning pin guides 222 align with the positioning pins 214 in the upper left section mating flange 212A and the lower left section mating flange 212B. Unthreaded bores 220 in the upper right section mating flange 218A and also in the lower right section mating flange 218B align with the threaded bores 216 in the upper left section mating flange 212A and also in the lower left section mating flange 212B, respectively.

The sectional intake manifold of the present invention has been illustrated by demonstrating modification of existing intake manifolds to produce a sectional intake manifold. One skilled in the art will understand that the present invention is not limited to modification of an existing intake manifold. Rather, a sectional intake manifold according to the present invention can be fabricated at the outset. A cast sectional intake manifold will be easier to cast in separate pieces, although the flange faces produced by the casting process may require precision machining.

The sectional intake manifolds described herein have been illustrated to include both front-back sectional intake manifolds and left-right sectional intake manifolds. As illustrated herein, each sectional intake manifold has only two sections. It will be understood by one skilled in the art that a sectional intake manifold having more than two sections is within the scope of the present invention. The prior art small-block V-8 sheet metal intake manifold of FIG. 5 was first modified according to the present invention to produce a front-back sectional manifold (See FIGS. 6–8). Then, in FIGS. 9–11 the same prior art intake manifold was modified according to the teaching of the present invention to produce a left-right sectional manifold. It will be understood by one skilled in the art that the front section FF (FIG. 6) could be modified according to the present invention to produce a left section and a right section. Appropriate mating flanges would permit the three-piece sectional intake manifold to be reassembled to obtain the same overall configuration, with respect to the cylinder heads, as the unmodified prior art intake manifold.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A sectional intake manifold for attachment to cylinder heads of a carbureted internal combustion engine, said sectional intake manifold comprising:

a first intake manifold section having a first section mating flange, said first intake section containing front section intake runners, front section vanes, and a front section plenum area, said intake runners and vanes directing the fuel-air mixture from the carburetor to at least two of the cylinders, said first section mating flange having at least two unthreaded bores therein;

a second intake manifold section having a second section mating flange, said second intake manifold section containing backsection intake runners, back section vanes, and a back section plenum area, said intake runners and vanes directing the fuel-air mixture from the carburetor to the remaining cylinders, said second intake manifold section mating flange having at least two threaded bores therein;

at least two bolts, said bolts being disposed through said unthreaded bores in said first section mating flange and engaging said threaded bores in said second section mating flange, thereby fastening said first section mating flange to said second section mating flange; and sealing means for making a seal between said first section mating flange and said second section mating flange.

2. The device of claim 1, wherein said first section mating flange includes at least two positioning pins and said second section mating flange includes at least two positioning pin guides, so that said positioning pins in said first section mating flange are disposed within said positioning pin guides in said second section mating flange when said first intake manifold section and said second intake manifold section are properly aligned to fasten said first section mating flange to said second section mating flange.

3. The device of claim 1, wherein said first intake manifold section includes cooling water jacket connections and said second intake manifold section includes a distributor pad.

4. The device of claim 1, wherein said first intake section consists essentially of the front half of a conventional intake manifold and said second intake section consists essentially of the back half of the conventional intake manifold, said front and back halves being produced by cutting the conventional intake manifold.

5. The device of claim 1, wherein said first intake manifold section consists essentially of the left half of a conventional intake manifold and said second intake manifold section consists essentially of the right half of the conventional intake manifold, said left and right halves being produced by cutting the conventional intake manifold.

6. The device of claim 1, wherein said sealing means comprises a cylindrical compression gasket disposed within a groove in said first section mating flange.

7. The device of claim 1, wherein said first section mating flange is characterized as having a first section mating flange face and said second section mating flange is characterized as having a second section mating flange face, and said sealing means comprises a flat gasket disposed between said first section mating flange face and said second section mating flange face.

8. The device of claim 1, wherein said first section mating flange is characterized as having a first section mating flange face and said second section mating flange is characterized as having a second section mating flange face, and said sealing means comprises a bead of sealant between said first section mating flange face and said second section mating flange face.

9. A sectional intake manifold for attachment to cylinder heads of a fuel injected internal combustion engine, said sectional intake manifold comprising:

a first intake manifold section having a first section mating flange, said first intake section containing first intake manifold section runners, first intake manifold section vanes, and a first intake manifold section plenum area, said intake runners and vanes directing combustion air to at least two of the cylinders, said first section mating flange having at least two unthreaded bores therein;

a second intake manifold section having a second section mating flange, said second intake manifold section containing second intake manifold section runners, second intake manifold section vanes, and a second intake manifold section plenum area, said intake runners and vanes directing the air to the remaining cylinders, said second intake manifold section mating flange having at least two threaded bores therein;

at least two bolts, said bolts being disposed through said unthreaded bores in said first section mating flange and engaging said threaded bores in said second section mating flange, thereby fastening said first section mating flange to said second section mating flange; and sealing means for making a seal between said first section mating flange and said second section mating flange.

10. The device of claim 9, wherein said first section mating flange includes at least two positioning pins and said second section mating flange includes at least two positioning pin guides, so that, said positioning pins in said first section mating flange are disposed within said positioning pin guides in said second section mating flange when said first intake manifold section and said second intake manifold section are properly aligned for attachment to the cylinder heads.

11. The device of claim 9, wherein said first intake manifold section includes cooling water jacket connections and said second intake manifold section includes a distributor pad.

12. The device of claim 9, wherein said first intake section consists essentially of the front half of a conventional intake manifold and said second intake section consists essentially of the back half of the conventional intake manifold.

13. The device of claim 9, wherein said first intake section consists essentially of the left half of a conventional intake manifold and said second intake section consists essentially of the right half of the conventional intake manifold.

14. The device of claim 9, wherein said sealing means comprises a cylindrical compression gasket disposed within a groove in said first section mating flange.

15. The device of claim 9, wherein said first section mating flange is characterized as having a first section mating flange face and said second section mating flange is characterized as having a second section mating flange face, and said sealing means comprises a flat gasket disposed between said first section mating flange face and said second section mating flange face.

16. The device of claim 9, wherein said first section mating flange is characterized as having a first section mating flange face and said second section mating flange is characterized as having a second section mating flange face, and said sealing means comprises a bead of sealant between said first section mating flange face and said second section mating flange face.

17. A method of modifying a conventional air intake manifold to create a sectional intake manifold, the conventional air intake manifold being characterized as having a plenum, intake runners and vanes, the conventional air intake manifold being further characterized as having a front half and a back half, the conventional air intake manifold being still further characterized as having a carburetor flange and unthreaded bores in cylinder head mating flanges for securing the intake manifold to the cylinder heads, wherein the unthreaded bores in the cylinder head mating flanges form a hole pattern P, said method comprising the steps of:

cutting the conventional air intake manifold to create a front half and a back half, wherein said front half contains at least two intake runners and wherein said back half contains the remaining intake runners, and, further, wherein said front half includes two front cylinder head mating flanges having a hole pattern PF and said back half includes two back cylinder head mating flanges having a hole pattern PB;

welding a front section flange along the front half cut to form a front section;

welding a back section flange along the back half cut to form a back section;

machining said front section flange and said back section flange;

placing said front section flange adjacent said back section flange to create sectional intake manifold fastening said front section flange to said back section flange; and sealing any gap remaining between said front section flange and said back section flange, so that said hole pattern PF and said hole pattern PB form the hole pattern P of the conventional air intake manifold.

18. The method of claim 17, wherein said fastening step further comprises the steps of:

drilling at least two unthreaded bores in said front section flange;

drilling at least two threaded bores in said back section flange, said threaded bores being in said back section flange being aligned with said unthreaded bores in said front section flange; and placing bolts through said unthreaded bores in said front section flange and threading said bolts into said threaded bores in said back section flange.

19. The method of claim 17, further comprising the steps of:

attaching at least two positioning pins to said front section flange; and drilling at least two positioning pin guides in said back section flange, so that, when said positioning pins are inserted in said guides, said front section flange and said back section flange are spatially configured so that said unthreaded bores in said front section flange are aligned with said threaded bores in said back section flange.

20. A method of modifying a conventional air intake manifold to create a sectional intake manifold, the conventional air intake manifold being characterized as having a plenum, intake runners and vanes, the conventional air intake manifold being further characterized as having a left half and a right half, the conventional air intake manifold being still further characterized as having a carburetor flange and unthreaded bores in cylinder head mating flanges for securing the intake manifold to the cylinder heads, wherein the unthreaded bores in the cylinder head mating flanges form a hole pattern PP, said method comprising the steps of:

cutting the conventional air intake manifold to create a left half and a right half, wherein said left half contains at least two intake runners and wherein said right half contains the remaining intake runners, and, further, wherein said left half includes a left cylinder head mating flange having a hole pattern PPL and said right half includes a right cylinder head mating flange having a hole pattern PPR;

welding a left section flange along the left half cut to form a left section;

welding a right section flange along the right half cut to form a right section;

machining said left section flange and said right section flange so, when said left section flange is placed adjacent said right section flange, said sectional intake manifold has the same overall dimensions as the conventional air intake manifold;

placing said left section flange adjacent said right section flange to create sectional intake manifold;

fastening said left section flange to said right section flange; and sealing any gap remaining between said left section flange and said right section flange, so that said hole pattern PPL and said hole pattern PPR form the hole pattern PP of the conventional air intake manifold.

21. The method of claim 20, wherein said fastening step further comprises the steps of:

drilling at least two unthreaded bores in said left section flange;

drilling at least two threaded bores in said right section flange, said threaded bores in said right section flange being aligned with said unthreaded bores in said left section flange; and placing bolts through said unthreaded bores in said left section flange and threading said bolts into said threaded bores in said right section flange.

22. The method of claim 20, further comprising the steps of:

attaching at least two positioning pins to said left section flange; and drilling at least two positioning pin guides in said right section flange, so that, when said positioning pins are inserted in said guides, said left section flange and said right section flange are spatially configured so that said unthreaded bores in said left section flange are aligned with said threaded bores in said right section flange.

* * * * *